US010490927B2

(12) United States Patent
Lin et al.

(10) Patent No.: US 10,490,927 B2
(45) Date of Patent: Nov. 26, 2019

(54) SELF-ENCLOSED ELECTRICAL ASSEMBLY WITH WIRE CRIMPING STRUCTURE

(71) Applicant: Minghu Bao, Suzhou (CN)

(72) Inventors: Fei Lin, Suzhou (CN); Minghu Bao, Suzhou (CN)

(73) Assignee: Minghu Bao, Suzhou (CN)

( * ) Notice: Subject to any disclaimer, the term of this patent is extended or adjusted under 35 U.S.C. 154(b) by 0 days.

(21) Appl. No.: 15/786,233

(22) Filed: Oct. 17, 2017

(65) Prior Publication Data

US 2019/0058276 A1 Feb. 21, 2019

(30) Foreign Application Priority Data

Aug. 16, 2017 (CN) ..... 2017 1 0699768
Aug. 16, 2017 (CN) ..... 2017 2 1022495 U

(51) Int. Cl.

| | |
|---|---|
| ***H01R 13/428*** | (2006.01) |
| ***H01R 13/11*** | (2006.01) |
| ***H01R 4/2495*** | (2018.01) |
| ***H01R 4/2433*** | (2018.01) |
| ***H01R 4/2475*** | (2018.01) |
| ***H01R 4/2454*** | (2018.01) |

(52) U.S. Cl.

CPC ..... *H01R 13/428* (2013.01); *H01R 4/2433* (2013.01); *H01R 4/2454* (2013.01); *H01R 4/2475* (2013.01); *H01R 4/2495* (2013.01); *H01R 13/114* (2013.01)

(58) Field of Classification Search

CPC .. H01R 4/2433; H01R 4/2475; H01R 4/2416; H01R 4/2445; H01R 4/2454

See application file for complete search history.

(56) References Cited

U.S. PATENT DOCUMENTS 5,149,278 A * 9/1992 Waas ..... H01R 4/2408 439/412
5,836,791 A * 11/1998 Waas ..... H01R 4/2433 439/709
6,142,815 A * 11/2000 Whiteman, Jr. ..... H01R 9/24 439/381
6,264,495 B1 * 7/2001 Robertson ..... H01R 4/2433 439/409
6,264,496 B1 * 7/2001 Robertson ..... H01R 4/2433 439/409

(Continued)

*Primary Examiner* — Felix O Figueroa
(74) *Attorney, Agent, or Firm* — Chen Yoshimura LLP

(57) ABSTRACT

A self-enclosed electrical assembly with a wire crimping structure, including an installation faceplate, a front assembly, and a back assembly affixed to each other using buckles. The front assembly includes a base plate and an open-top enclosure member extending perpendicularly from the base plate. Disposed inside the enclosure member are plug insertion pieces with wire receiving slots. The back assembly includes a top panel and a shell body extending perpendicularly from the top panel. Disposed within the shell body is a wire crimping structure, which includes a wire crimping block and an inserted member. The wire crimping block has multiple wire crimping notches respectively spatially corresponding to the wire receiving slots. After the back assembly and the front assembly are affixed to each other, the inserted member is used to press the crimping block to crimp the wires into the wire receiving slots.

14 Claims, 5 Drawing Sheets

(56) References Cited

U.S. PATENT DOCUMENTS

| | | | | |
|---|---|---|---|---|
| 6,730,844 | B2 * | 5/2004 | Reiker | H01R 4/2433 174/60 |
| 7,306,482 | B1 * | 12/2007 | Kidman | H01R 13/73 439/538 |
| 8,383,940 | B2 * | 2/2013 | Yoshida | H01R 4/2454 174/68.2 |
| 9,698,584 | B2 * | 7/2017 | Shotey | H02G 3/14 |

* cited by examiner

SELF-ENCLOSED ELECTRICAL ASSEMBLY WITH WIRE CRIMPING STRUCTURE

BACKGROUND OF THE INVENTION

Field of the Invention

This invention relates generally to electrical assemblies, and in particular, it relates to a self-enclosed electrical assembly with a wire crimping structure.

Description of Related Art

For conventional self-enclosed electrical assembly that do not require junction boxes, such as self-enclosed power outlet socket or switch, during assembly, the user needs to first use special purpose manual crimping pliers to press the electrical wires into corresponding wire receiving slots in the housing. Since there are typically two to three sets of electrical wires, the wire crimping process is cumbersome and requires multiple separate steps. The process is time consuming and laborious, and the crimping pliers are also frequently damaged.

SUMMARY

To solve the above problems, the present invention provides a self-enclosed electrical assembly that has a wire crimping structure. It can crimp multiple electrical wires at once, without using crimp pliers. Such electrical assemblies are easy to install, reliable, and can save time and labor during installation.

To achieve the above objects, the present invention provides a self-enclosed electrical assembly with a wire crimping structure, which includes an installation faceplate, a front assembly, and a back assembly, which are affixed to each other using buckles. The front assembly includes a base plate, and an enclosure member which extends perpendicularly from the base plate and which has an open top. Disposed inside the enclosure member are plug insertion pieces that have wire receiving slots. The back assembly includes a top panel, and a shell body which extends perpendicularly from the top panel. Disposed within the shell body is a wire crimping structure, which includes a wire crimping block and an inserted member, wherein the wire crimping block has multiple wire crimping notches respectively spatially corresponding to the wire receiving slots. After the back assembly and the front assembly are affixed to each other by the buckles, the inserted member is used to press the crimping block so as to crimp the wires into the wire receiving slots.

The following preferred embodiments are disclosed:

In some preferred embodiments, each plug insertion piece further includes a plurality of U shaped guiding slots, each located at a wire receiving end of one of the wire receiving slots, each U shaped guiding slot being configured to accommodate at least two electrical wires.

In some preferred embodiments, the inserted member includes at least one screw configured to be screwed into the back assembly from the top panel, wherein the wire crimping structure further includes a pressing plate configured to cooperate with the wire crimping block, and wherein the inserted member is configured to contact and press the pressing plate.

In some preferred embodiments, the wire crimping block includes positioning posts and the pressing plate includes corresponding positioning holes, or the wire crimping block includes positioning holes and the pressing plate includes corresponding positioning posts, and wherein the wire crimping block and the pressing plate are aligned and registered with each other via the positioning holes and positioning posts.

In some preferred embodiments, the wire crimping structure further includes at least one spring disposed between the top panel and the pressing plate of the back assembly, the spring being configured to keep the pressing plate and the wire crimping block in an un-pressed position before the inserted member presses the pressing plate.

In some preferred embodiments, the faceplate includes a plurality of resilient cone shaped buckles, and the base plate of the front assembly includes a plurality of corresponding buckle receivers, wherein the buckles and the buckle receivers are configured to engage with each other to affix the faceplate and the front assembly to each other.

In some preferred embodiments, the faceplate includes at least one pry slot on at least one side, configured to receive a tool to be inserted therein for separating the faceplate and the front assembly by prying.

In some preferred embodiments, the enclosure member of the front assembly includes a plurality of resilient hooks on its side walls and the shell body of the back assembly includes a plurality of corresponding hook receiving structures on its side walls, or the shell body of the back assembly includes a plurality of resilient hooks on its side walls and the enclosure member of the front assembly includes a plurality of corresponding hook receiving structures on its side walls, and wherein the resilient hooks and the corresponding hook receiving structures are configured to engage with each other to affix the front assembly and the back assembly to each other.

In some preferred embodiments, an amount of engagement between a first resilient hook and a corresponding first hook receiving structure, which are located near an end of the side walls on which they are respectively located, is smaller than an amount of engagement between a second resilient hook and a corresponding second hook receiving structure, which are located near a center of the side walls on which they are respectively located.

In some preferred embodiments, the electrical assembly further includes at least one install stop, each disposed adjacent a side wall of the enclosure member of the front assembly, each including a screw hole and an arm, wherein at least one corresponding side wall of the shell body of the back assembly includes at least one wing, wherein the screw hole is configured to receive a screw, and wherein when the screw is screwed in, the install stop is configured to rotate in a clockwise direction to contact the corresponding wing.

In some preferred embodiments, the front assembly further includes at least one blocking plate which extends outwardly from the side wall of the enclosure member adjacent the install stop, in a substantially perpendicular direction with respect to the side wall, the blocking plate being configured to block the arm of the corresponding install stop to prevent it from rotating beyond a defined range in a counter-clockwise direction.

In some preferred embodiments, the electrical assembly is a power outlet socket, a ground-fault circuit interrupter, an electrical switch, or a light dimmer.

The self-enclosed electrical assembly with a wire crimping structure according to embodiments of the present invention can achieve the result that during installation, after the front assembly and back assembly are affixed to each other by the buckles, the wire crimping structure can simultaneously crimp multiple wires into the wire receiving slots.

This process is reliable and greatly saves the time and cost related to the wire crimping steps. The electrical assembly according to embodiments of the present invention is easy to install and uninstall, and is suitable for a variety of practical applications.

BRIEF DESCRIPTION OF THE DRAWINGS

Embodiments of the invention are described with reference to the following drawings. In the drawings, the same components are label with the same or similar reference symbols.

DETAILED DESCRIPTION OF PREFERRED EMBODIMENTS

Figure 1:
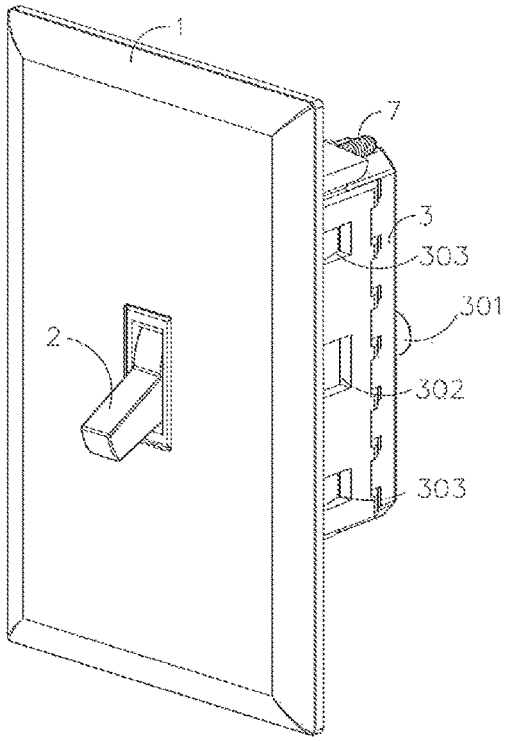
FIG. 1 is a front exterior view of a switch that employs a self-enclosed electrical assembly according to an embodiment of the present invention.

Embodiments of the present invention are described in detail below. It should be understood that the embodiments only illustrate specific ways to implement and use the present invention, and they do not limit the scope of the invention. When describing the structure and spatial relationship of the components, directional terms such as up, down, top, bottom etc. are not absolute, but are relative. The spatial relationship among components may change from those shown in the drawings, and the directional terms used to describe them will change accordingly.

Figure 2:
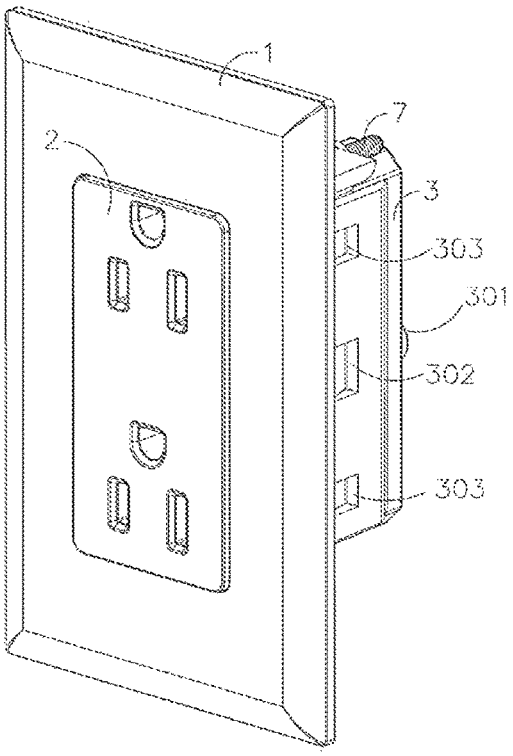
FIG. 2 is a front exterior view of a power outlet socket that employs a self-enclosed electrical assembly according to an embodiment of the present invention.

Referring to FIGS. 1 and 2, the self-enclosed electrical assembly with a wire crimping structure may be used in various practical applications, including power outlet socket, ground-fault circuit interrupter (GFCI), electrical switch, light dimmer, etc. FIG. 1 shows the electrical assembly as a part of a switch, and FIG. 2 shows the electrical assembly as a part of a socket. In each of these practical applications, the electrical assembly includes an installation faceplate 1, a front assembly 2 and a back assembly 3 that are fastened to each other using resilient buckles. In different practical applications, the front assembly 2 may be different structure, such as a switch lever in FIG. 1, a socket faceplate in FIG. 2, etc.

The structure and assembly process of a self-enclosed electrical assembly with wire crimping structure according to an embodiment of the present invention are described below with reference to FIGS. 3-8, using the power outlet socket application shown in FIG. 2 as an example.

Figure 7A:
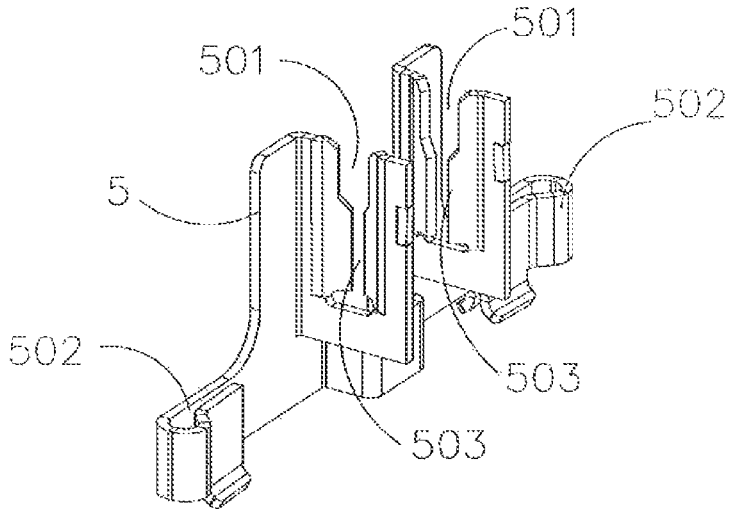
FIG. 7*a* illustrates an insertion piece of the self-enclosed socket.
Figure 7B:
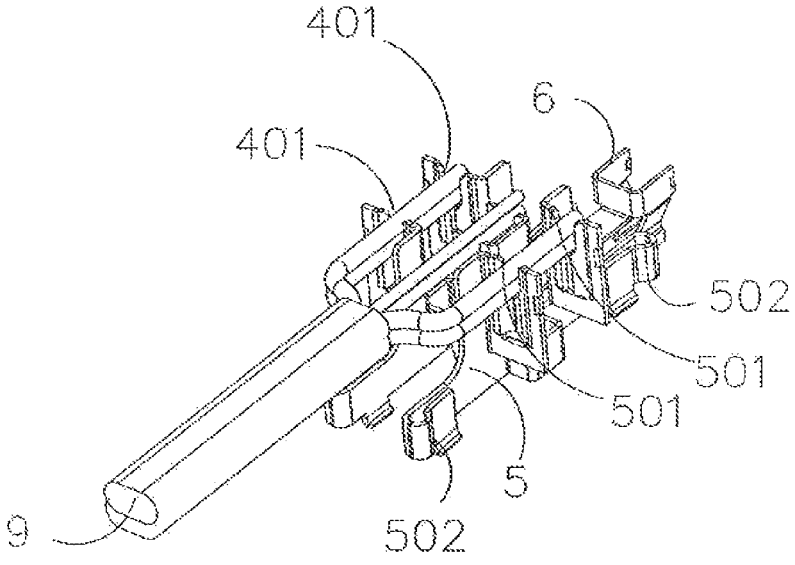
FIG. 7*b* illustrates the insertion piece of the self-enclosed socket with electrical wires loaded.
Figure 8:
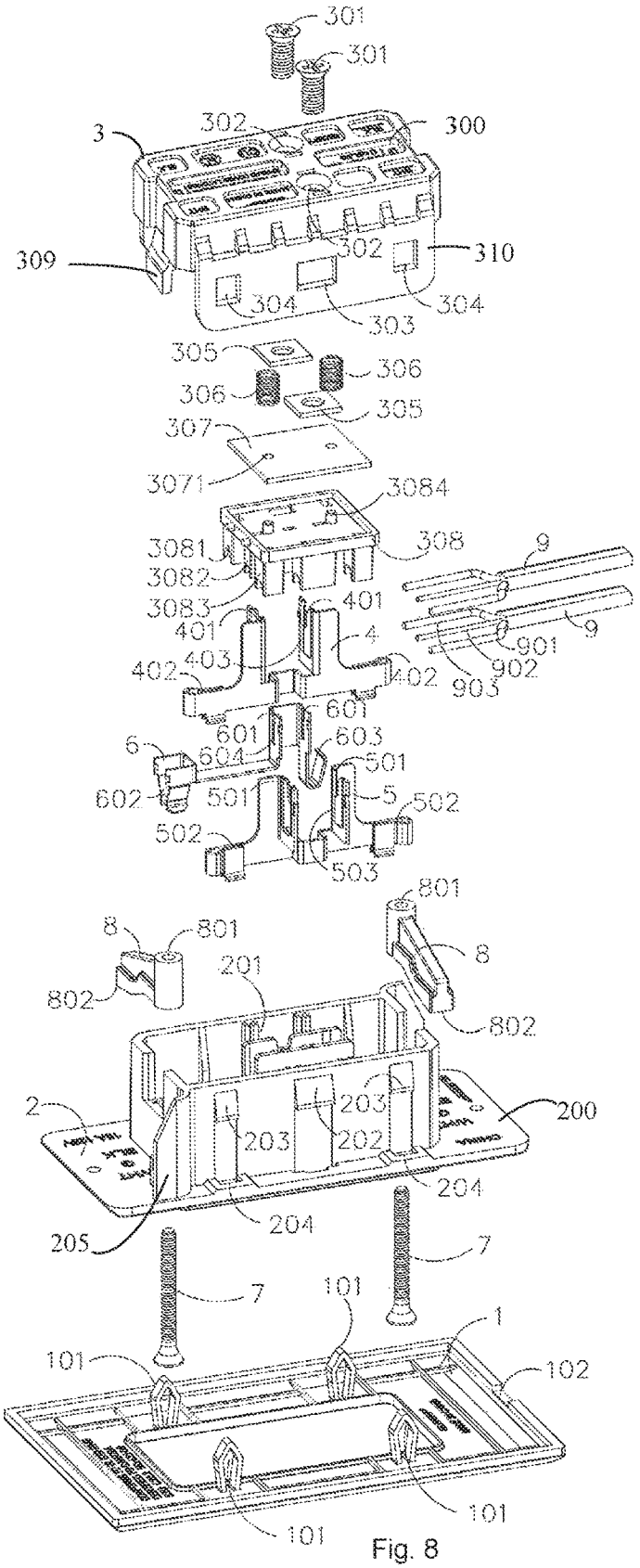
FIG. 8 is an exploded view of the self-enclosed socket.

In this embodiment, the front assembly 2 includes a base plate 200, and an enclosure member 201 which is perpendicular to and extends from the base plate and which has an open top. Disposed inside the enclosure member 201 are plug insertion pieces that have wire receiving slots, including neutral line insertion piece 4, hot line insertion piece 5, and ground line insertion piece 6. As shown in FIGS. 7*a*, 7*b* and 8, the neutral line insertion piece 4, hot line insertion piece 5 and ground line insertion piece 6 respectively include neutral wire receiving slots 403, hot wire receiving slots 503, and ground wire receiving slots 603, as well as neutral contact terminal 402, hot contact terminal 502, and ground contact terminal 602 for receiving the respective prongs of a power plug in order to output power. Each wire receiving slot has a U shaped guiding slot at the wire receiving end, such as the neutral wire guiding slots 401, hot wire guiding slots 501, and ground wire guiding slots 601. The U shaped guiding slots can accommodate at least two wires, making it possible to crimp at least two wires at once, simplifying the wire crimping process.

The back assembly 3 includes a top panel 300, and a shell body 310 which is perpendicular to and extends from the top panel 300. Disposed within the shell body 310 is a wire crimping structure, which includes a wire crimping block 308 which spatially corresponds to the wire receiving slots of the insertion pieces of the front assembly 2, and an inserted member. The wire crimping block 308 has multiple wire crimping notches 3081, 3082 and 3083, respectively spatially corresponding to the wire guiding slots or wire receiving slots. The inserted member may be one or more screws 301 (two are shown in the drawings) inserted from the top panel 300 of the back assembly 3. The wire crimping structure further includes a pressing plate 307 which cooperates with the wire crimping block 308, where the screws 301 pass through the washers 305 to contact and press on the pressing plate 307. The pressing plate 307 and the wire crimping block 308 are spatially registered with each other; for example, as shown in FIG. 8, the wire crimping block 308 has positioning posts 3084 and the pressing plate 307 has corresponding positioning holes 3071. When assembling the back assembly 3, the washers 305 are first placed in the back assembly 3; the screws 301 are screwed in, riveted and then withdrawn. The pressing plate 307 is aligned and registered with the wire crimping block 308 via the positioning holes and positioning posts, and they are together inserted into the shell body 310 of the back assembly 3. This completes the assembly of the back assembly 3.

When installing the electrical assembly (socket) at the intended location, as shown in FIG. 7*b*, two power cables 9 are provided, each cable having three metal wires, each individually covered with an insulator, and an outer cover that enclosed the three insulated metal wires. The outer PVC cover for a segment of each cable is stripped to expose the three insulated metal wires. The insulating layer of the wires are not removed at this time. The insulated wires may be shaped as desired if necessary. The two neutral wires and two hot wires of the two cables are respectively fitted into the neutral wire guiding slots 401 of the neutral line insertion piece 4 and the hot wire guiding slots 501 of the hot line insertion piece 5, and the two ground wires are fitted into the ground wire guiding slots 601 of the ground line insertion piece 6. Then, the back assembly 3 and the front assembly 2 are affixed to each other via buckles. The screws 301 are screwed into the back assembly 3 using an electric screw driver, so that the wire crimping notches of the wire crimping block 308 press the wires into the corresponding wire receiving slots. When the wires are pressed into the wire receiving slots, the wire receiving slots puncture the insulating layers of the wires and tightly clamp the wires. This completes the wiring of the self-enclosed power outlet socket.

Figure 4:
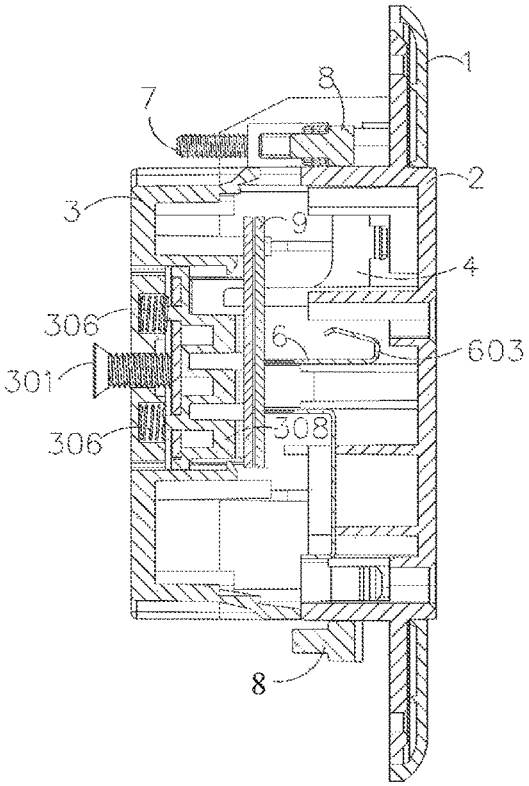
FIG. 4 is a cross-sectional view of the self-enclosed socket of FIG. 2 before the electrical wires are crimped.
Figure 5:
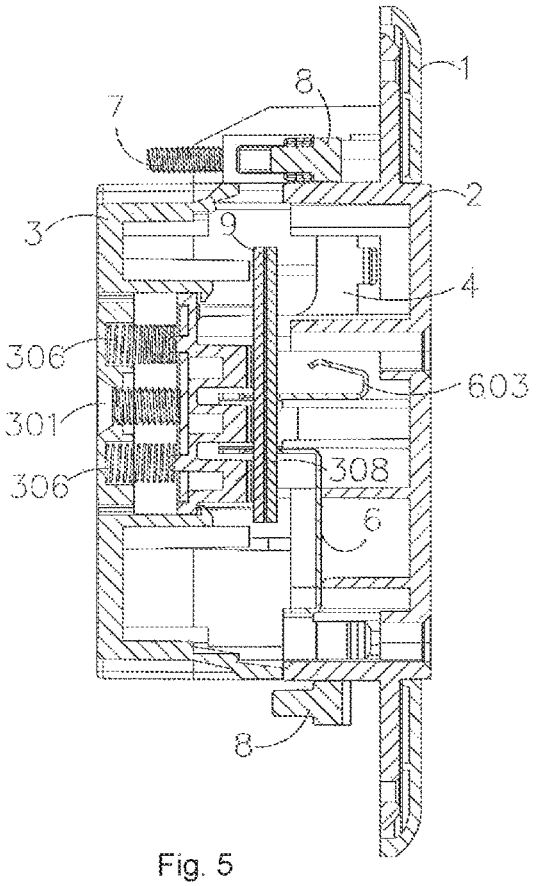
FIG. 5 is a cross-sectional view of the self-enclosed socket of FIG. 2 after the electrical wires are crimped.

The wire crimping structure additionally includes at least one spring 306 (two are shown in the drawings) disposed between the top panel 300 and the pressing plate 307 of the back assembly 3. As shown in FIGS. 4 and 5, the springs 306 are in their natural state when the screws 301 are not yet screwed in and the pressing plate 307 and the wire crimping block 308 are in the un-pressed position. After the screws 301 are screwed in, under the force of the screws, the springs 306 are stretched, and the pressing plate 307 and wire crimping block 308 move downwards to press the wires into the wire receiving slots. While in the illustrated embodiment the two springs 306 are respectively affixed to the positioning posts 3084, in other embodiments, they may be affixed to the screws 301, for example they may be respectively disposed around the screws.

After the wiring step is completed, the front assembly 2 and the faceplate 1 are assembled together in a screw-less manner using buckles. To achieve this, the faceplate 1 is provided with multiple resilient cone shaped buckles 101 (four are shown in FIG. 8). Correspondingly, the base plate 200 of the front assembly 2 is provided with multiple buckle receivers 204. When assembling the faceplate 1 and the front assembly 2, the multiple cone shaped buckles 101 are respectively aligned with and inserted into the multiple buckle receivers 204. Because the mid-section of each cone shaped buckle 101 is slanted so that buckle is wider toward the top, the cone shaped buckle 101 becomes stuck in the buckle receiver 204, which achieves spring-loaded mounting of the faceplate 1 with the front assembly 2. FIG. 8 also shows that the faceplate 1 is provided with a pry slot 102 on at least one side, which allows a tool to be inserted to separate the faceplate 1 and the front assembly 2 by prying. Because the cone shaped buckles 101 are resilient, with a sufficient prying force, they will slide out of the buckle receivers 204, allowing the faceplate 1 and the front assembly 2 to separate.

As mentioned earlier, the back assembly 3 and the front assembly 2 are affixed to each other by buckles. To achieve this, the side walls of the enclosure member 201 of the front assembly 2 are provided with multiple resilient hooks, and the side walls of the shell body 310 of the back assembly 3 are provided with multiple hook receiving structures. Alternatively, hooks may be provided on the shell body 310 and hook receiving structures may be provided on the enclosure member 201, or opposing hooks may be provided on the shell body 310 and the enclosure member 201, etc. In a preferred embodiment, of the multiple hooks and hook receiving structures, the ones located near the two ends of the side wall have a smaller amount of engagement between the hook and the hook receiving structure as compared to the ones located near the center of the side wall. As shown in FIG. 8, the side wall of the front assembly 2 is provided with three hooks (there are three other hooks on the opposite side wall, not visible in FIG. 8), including a larger hook 202 near the center of the side wall and two smaller hooks 203 near the two ends of the side wall. Correspondingly, the side wall of the back assembly 3 is provided with three hook receiving structure s (there are three other ones on the opposite side wall, not visible in FIG. 8), including a larger hook receiving structure 303 near the center of the side wall and two smaller hook receiving structures 304 near the two ends of the side wall. Using three sets (and three more sets on the opposite side wall) of hooks and hook receiving structures, the front assembly 2 and the back assembly 3 can be securely fastened to each other. In addition, when the front assembly 2 and the back assembly 3 need to be separated, such as to replace the socket or to add or change wires, the above-described structure is easier to operate than conventional devices. Conventional devices typically have multiple hooks and hook receiving structures that are independent of each other; when one hook is pried to disengage from its hook receiving structure, the other hooks are still engaged with their hook receiving structures, making it hard to separate the two pieces. In the embodiment of the present invention, the three hooks or the three hook receiving structures are formed integrally; when separating the two pieces, one only needs to pry from an end of the side wall toward the center, and because the amount of engagement of the hook is smaller for the hooks near the end, less amount of prying is required so it is relatively easy to pry the back assembly 3 off from the front assembly 2.

In one embodiment, the electrical assembly additionally includes at least one install stop. As shown in FIG. 8, two install stops 8 are provided near the two opposing side walls of the front assembly 2. Each install stop 8 includes a screw hole 801 and an arm 802, where the screw hole 801 receives an install screw 7. On the corresponding side walls of the shell body 310 of the back assembly 3, corresponding wings 309 are provided. After the wiring of the self-enclosed socket is completed, the socket is placed in the hollow space of the wall, and the install screw 7 is screwed in using an electric screw driver. The install stop 8 rotates in a clockwise direction due to the rotation of the install screw 7, until it contacts the wing 309 of the back assembly 3, where the install stop 8 stops and presses the wing 309. When the install screw 7 continues to be screwed in, the install stop 8 causes the front assembly 2 and the back assembly 3 to be tightly affixed to each other. This completes the installation of the electrical device.

Figure 3:
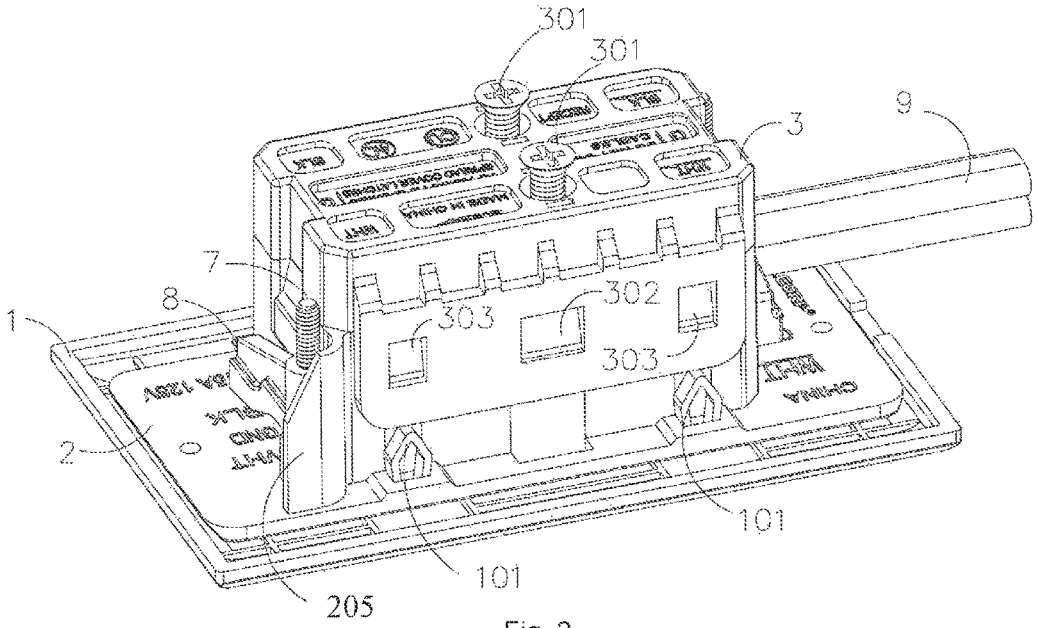
FIG. 3 is a rear exterior view of the self-enclosed socket of FIG. 2.
Figure 6:
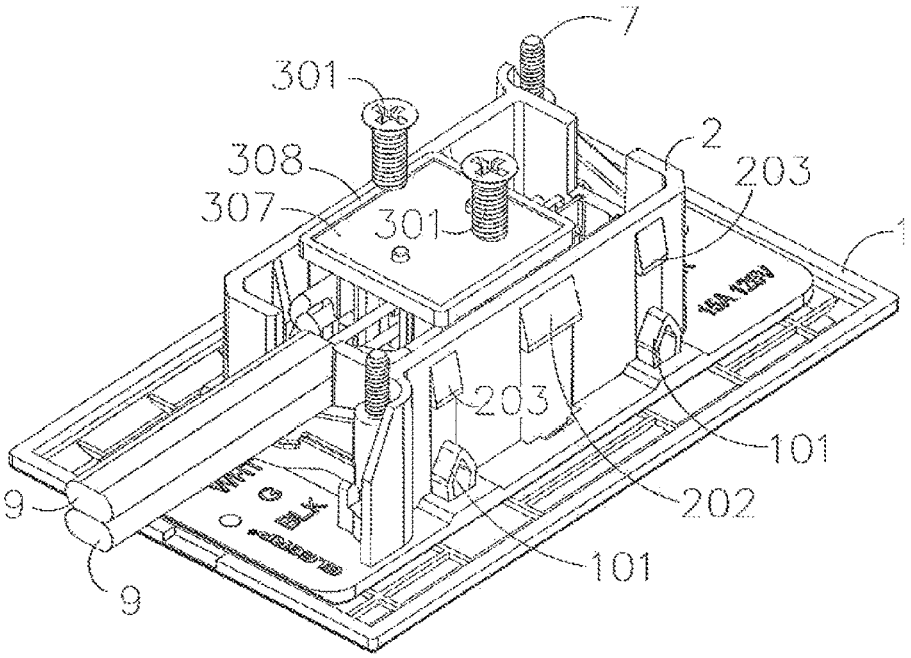
FIG. 6 is a rear view of the self-enclosed socket of FIG. 2 with the shell of the back assembly and some other components removed.

As shown in FIGS. 3, 6 and 8, the front assembly 2 further includes at least one blocking plate 205 which extends outwardly from the side wall of the enclosure member 201 adjacent the install stop, in a substantially perpendicular direction with respect to the side wall. Two blocking plates 205 on opposite side walls are shown in the Figures. The blocking plates 205 can block the arm 802 of the corresponding install stop 8 to prevent it from rotating too far, e.g. beyond a defined range, in a counter-clockwise direction.

The self-enclosed electrical assembly with a wire crimping structure according to embodiments of the present invention can achieve the result that during installation, after the front assembly and back assembly are affixed to each other by the buckles, the wire crimping structure can simultaneously crimp multiple wires into the wire receiving slots. This process is reliable and greatly saves the time and cost related to the wire crimping steps. The electrical assembly according to embodiments of the present invention is easy to install and uninstall, and is suitable for a variety of practical applications.

It will be apparent to those skilled in the art that various modification and variations can be made in the electrical assembly and related method of the present invention without departing from the spirit or scope of the invention. Thus, it is intended that the present invention cover modifications and variations that come within the scope of the appended claims and their equivalents.

What is claimed is:

1. A self-enclosed electrical assembly, comprising:

an installation faceplate, a front assembly, and a back assembly affixed to each other;

the front assembly comprising:

a base plate;

an enclosure member which extends perpendicularly from the base plate and which has an open top; and a plurality of plug insertion pieces disposed inside the enclosure member, each plug insertion piece having one or more wire receiving slots; and the back assembly comprising:

a top panel;

a shell body which extends perpendicularly from the top panel; and a wire crimping structure disposed within the shell body, wire crimping structure including a wire crimping block and an inserted member, wherein the wire crimping block has multiple wire crimping notches respectively spatially corresponding to the wire receiving slots, wherein the inserted member is operable, after the back assembly and the front assembly are affixed to each other, to press the crimping block to crimp electrical wires located above the wire receiving slots into the wire receiving slots, and at least one install stop, each disposed adjacent a side wall of the enclosure member of the front assembly, each including a screw hole and an arm, wherein at least one corresponding side wall of the shell body of the back assembly includes at least one wing, wherein the screw hole is configured to receive a screw, and wherein when the screw is screwed in, the install stop is configured to rotate in a clockwise direction to contact the corresponding wing.

2. The self-enclosed electrical assembly of claim 1, wherein the front assembly further includes at least one blocking plate which extends outwardly from the side wall of the enclosure member adjacent the install stop, in a substantially perpendicular direction with respect to the side wall, the blocking plate being configured to block the arm of the corresponding install stop to prevent the corresponding install stop from rotating beyond a defined range in a counter-clockwise direction.

3. A self-enclosed electrical assembly, comprising:

an installation faceplate, a front assembly, and a back assembly affixed to each other;

the front assembly comprising:

a base plate;

an enclosure member which extends perpendicularly from the base plate and which has an open top; and a plurality of plug insertion pieces disposed inside the enclosure member, each plug insertion piece having one or more wire receiving slots; and the back assembly comprising:

a top panel;

a shell body which extends perpendicularly from the top panel; and a wire crimping structure disposed within the shell body, wire crimping structure including a wire crimping block and an inserted member, wherein the wire crimping block has multiple wire crimping notches respectively spatially corresponding to the wire receiving slots, wherein the inserted member is operable, after the back assembly and the front assembly are affixed to each other, to press the crimping block to crimp electrical wires located above the wire receiving slots into the wire receiving slots, wherein each plug insertion piece further includes a plurality of U shaped guiding slots, each located at a wire receiving end of one of the wire receiving slots, each U shaped guiding slot being configured to accommodate at least two electrical wires, wherein the inserted member includes at least one screw configured to be screwed into the back assembly from the top panel, wherein the wire crimping structure further includes a pressing plate configured to cooperate with the wire crimping block, and wherein the inserted member is configured to contact and press the pressing plate, and wherein the wire crimping block includes positioning posts and the pressing plate includes corresponding positioning holes, or the wire crimping block includes positioning holes and the pressing plate includes corresponding positioning posts, and wherein the wire crimping block and the pressing plate are aligned and registered with each other via the positioning holes and positioning posts.

4. The self-enclosed electrical assembly of claim 3, wherein the wire crimping structure further includes at least one spring disposed between the top panel and the pressing plate of the back assembly, the spring being configured to keep the pressing plate and the wire crimping block in an un-pressed position before the inserted member presses the pressing plate.

5. The self-enclosed electrical assembly of claim 3, wherein the enclosure member of the front assembly includes a plurality of resilient hooks on its side walls and the shell body of the back assembly includes a plurality of corresponding hook receiving structures on its side walls, or the shell body of the back assembly includes a plurality of resilient hooks on its side walls and the enclosure member of the front assembly includes a plurality of corresponding hook receiving structures on its side walls, and wherein the resilient hooks and the corresponding hook receiving structures are configured to engage with each other to affix the front assembly and the back assembly to each other.

6. The self-enclosed electrical assembly of claim 5, wherein an amount of engagement between a first resilient hook and a corresponding first hook receiving structure, which are located near an end of the side walls on which they are respectively located, is smaller than an amount of engagement between a second resilient hook and a corresponding second hook receiving structure, which are located near a center of the side walls on which they are respectively located.

7. The self-enclosed electrical assembly of claim 3, wherein the faceplate includes a plurality of resilient cone shaped buckles, and the base plate of the front assembly includes a plurality of corresponding buckle receivers, wherein the buckles and the buckle receivers are configured to engage with each other to affix the faceplate and the front assembly to each other.

8. The self-enclosed electrical assembly of claim 7, wherein the faceplate includes at least one pry slot on at least one side, configured to receive a tool to be inserted therein for separating the faceplate and the front assembly by prying.

9. The self-enclosed electrical assembly of claim 3, wherein the electrical assembly is a power outlet socket, a ground-fault circuit interrupter, an electrical switch, or a light dimmer.

10. A self-enclosed electrical assembly, comprising:

an installation faceplate, a front assembly, and a back assembly affixed to each other;

the front assembly comprising:

a base plate;

an enclosure member which extends perpendicularly from the base plate and which has an open top; and a plurality of plug insertion pieces disposed inside the enclosure member, each plug insertion piece having one or more wire receiving slots; and the back assembly comprising:

a top panel;

a shell body which extends perpendicularly from the top panel; and a wire crimping structure disposed within the shell body, wire crimping structure including a wire crimping block, a pressing plate, and an inserted member, wherein the wire crimping block has multiple wire crimping notches respectively spatially corresponding to the wire receiving slots, wherein the pressing plate is a flat plate having a flat first side and a flat second side opposite to each other, wherein the pressing plate and the wire crimping block are distinct pieces, and the pressing plate is configured to cooperate with the wire crimping block, wherein the inserted member includes at least one screw configured to be screwed into the back assembly from the top panel, wherein the inserted member is operable, after the back assembly and the front assembly are affixed to each other, to contact and press the first side of the pressing plate, wherein the second side of the pressing plate in turn presses the crimping block to crimp electrical wires located above the wire receiving slots into the wire receiving slots.

11. The self-enclosed electrical assembly of claim 10, wherein the electrical assembly is a power outlet socket, a ground-fault circuit interrupter, an electrical switch, or a light dimmer.

12. A self-enclosed electrical assembly, comprising:

an installation faceplate, a front assembly, and a back assembly affixed to each other;

the front assembly comprising:

a base plate;

an enclosure member which extends perpendicularly from the base plate and which has an open top; and a plurality of plug insertion pieces disposed inside the enclosure member, each plug insertion piece having one or more wire receiving slots; and the back assembly comprising:

a top panel;

a shell body which extends perpendicularly from the top panel; and a wire crimping structure disposed within the shell body, wire crimping structure including a wire crimping block and an inserted member, wherein the wire crimping block has multiple wire crimping notches respectively spatially corresponding to the wire receiving slots, wherein the inserted member is operable, after the back assembly and the front assembly are affixed to each other, to press the crimping block to crimp electrical wires located above the wire receiving slots into the wire receiving slots;

wherein the enclosure member of the front assembly includes a plurality of resilient hooks on its side walls and the shell body of the back assembly includes a plurality of corresponding hook receiving structures on its side walls, or the shell body of the back assembly includes a plurality of resilient hooks on its side walls and the enclosure member of the front assembly includes a plurality of corresponding hook receiving structures on its side walls, and wherein the resilient hooks and the corresponding hook receiving structures are configured to engage with each other to affix the front assembly and the back assembly to each other, wherein an amount of engagement between a first resilient hook and a corresponding first hook receiving structure, which are located near an end of the side walls on which they are respectively located, is smaller than an amount of engagement between a second resilient hook and a corresponding second hook receiving structure, which are located near a center of the side walls on which they are respectively located.

13. The self-enclosed electrical assembly of claim 10, wherein the faceplate includes a plurality of resilient cone shaped buckles, and the base plate of the front assembly includes a plurality of corresponding buckle receivers, wherein the buckles and the buckle receivers are configured to engage with each other to affix the faceplate and the front assembly to each other.

14. The self-enclosed electrical assembly of claim 13, wherein the faceplate includes at least one pry slot on at least one side, configured to receive a tool to be inserted therein for separating the faceplate and the front assembly by prying.

* * * * *